US006157863A

United States Patent [19]

Chandler et al.

[11] Patent Number: 6,157,863

[45] Date of Patent: Dec. 5, 2000

[54] APPARATUS AND METHOD FOR LEVELING OPTICAL FIBERS BEFORE POLISHING

[75] Inventors: William Keith Chandler, Woodsboro; Nadir Shah, Elkridge, both of Md.

[73] Assignee: CIENA Corporation, Linthicum, Md.

[21] Appl. No.: 09/032,034

[22] Filed: Feb. 27, 1998

[51] Int. Cl.[7] ..... G05D 1/02

[52] U.S. Cl. ..... 700/56; 451/278; 700/302; 385/85

[58] Field of Search ..... 385/85, 52, 97; 700/59, 58, 57, 56, 66, 302, 301; 702/152, 162; 73/862.046; 451/278

[56] References Cited

U.S. PATENT DOCUMENTS

| | | | |
|---|---|---|---|
| 3,657,475 | 4/1972 | Peronneau et al. | 178/18.05 |
| 4,693,035 | 9/1987 | Doyle | 451/278 |
| 4,745,812 | 5/1988 | Amazeen et al. | 73/862.041 |
| 4,827,763 | 5/1989 | Bourland et al. | 73/172 |
| 4,839,512 | 6/1989 | Speck | 250/231.1 |
| 4,905,415 | 3/1990 | Moulin | 451/276 |
| 4,924,711 | 5/1990 | Reilly | 250/423 R |
| 4,958,520 | 9/1990 | Trommler et al. | 73/727 |
| 4,967,518 | 11/1990 | Moulin | 451/57 |
| 5,010,772 | 4/1991 | Bourland et al. | 73/862.046 |
| 5,010,774 | 4/1991 | Kikuo et al. | 73/872.046 |
| 5,018,316 | 5/1991 | Mulholland et al. | 451/364 |
| 5,038,524 | 8/1991 | Moulin | 451/548 |
| 5,201,148 | 4/1993 | Rupert et al. | 451/364 |
| 5,209,119 | 5/1993 | Polla et al. | 73/723 |
| 5,321,917 | 6/1994 | Franklin et al. | 451/386 |
| 5,331,118 | 7/1994 | Jensen | 177/25.14 |
| 5,403,227 | 4/1995 | Franklin et al. | 451/168 |
| 5,447,464 | 9/1995 | Franklin et al. | 451/28 |
| 5,497,443 | 3/1996 | Jie et al. | 385/134 |
| 5,577,149 | 11/1996 | Averback et al. | 385/134 |
| 5,640,475 | 6/1997 | Takahashi | 385/85 |
| 5,643,064 | 7/1997 | Grinderslev et al. | 451/378 |
| 5,674,114 | 10/1997 | Miller et al. | 451/278 |
| 5,711,701 | 1/1998 | Grinderslev et al. | 451/378 |
| 5,720,653 | 2/1998 | Miller et al. | 451/278 |
| 5,911,158 | 6/1999 | Henderson et al. | 73/583 |
| 6,039,630 | 3/2000 | Chandler et al. | 451/6 |
| 6,077,154 | 6/2000 | Takashi et al. | 451/271 |

*Primary Examiner*—William Grant
*Assistant Examiner*—Edward F. Gain
*Attorney, Agent, or Firm*—Daniel N. Daisak; David L. Soltz

[57] ABSTRACT

An optical fiber alignment apparatus for leveling respective distal ends of a plurality of optical fibers prior to commencing a polishing process. The apparatus includes an aligning device having a plurality of receptacles for securing the corresponding plurality of optical fibers such that distal ends of the optical fibers extend below the base of the aligning device. A sensor array contacts the distal ends of the optical fibers and generates sensor alignment signals indicating the position of the fiber distal ends extending below the aligning device relative to a horizontal reference plane. A monitor receives and displays digital signals corresponding to the sensor alignments signals. Those optical fibers that are not aligned are then adjusted to until all the fibers are aligned and leveled with respect to the horizontal reference plane as viewed on the monitor. The precision of the horizontal alignment offered by the sensor array and digital monitor display allows the subsequent polishing process to be performed with a greater degree of reliability and consistency.

10 Claims, 3 Drawing Sheets

APPARATUS AND METHOD FOR LEVELING OPTICAL FIBERS BEFORE POLISHING

BACKGROUND OF THE INVENTION

1. Field of the Invention

The present invention generally relates to leveling and polishing optical fibers, and more particularly, to an apparatus and method for leveling or balancing optical fibers relative to each other prior to conducting a polishing process to ensure polishing uniformity.

2. Description of the Related Art

Optical fibers are very light, very fragile, and have very small dimensions. During their initial manufacture, there are practical limitations on the lengths of optical fibers that can be drawn. Therefore, the connections between the fibers to create longer designated lengths of fiber are accomplished by splicing. In addition, optical fibers or optical devices must be connected to pieces of terminal equipment, such as optical transmitters and optical receivers, to create functioning optical systems.

The nature of the fibers themselves, both in the material used in their fabrication and in the minute physical dimensions involved, combined with submicron alignment requirements, make connectorization operations difficult. Problems with efficient transfer of energy, minimized optical reflections, and mechanical integrity must be addressed. The complexities of interconnecting the fibers demands careful attention to connector design and a high level of precision in polishing operations.

Optical losses caused by poor connections or poor polishing operations may take many forms. Of course, lateral or axial misalignment of the fibers will cause less than optimal light transfer. Care should also be taken to reduce Fresnel reflection losses, which may be introduced by both the glass-to-air and air-to-glass interfaces if end separation between fibers is excessive. Also, the quality of both fiber ends has an effect on the power coupling. For example, rough or unpolished fiber ends not only contribute to separation losses, they may also scratch or fracture an adjacent polished fiber end. Losses may also occur if the fiber ends lack perpendicularity when joined, which may be caused by uneven polishing. Still other losses may occur where the fiber ends are over polished, thereby producing convex shaped ends that affect the transfer of light.

Before conducting the polishing step, special holding jigs or fixtures, such as the aligning device 100 in FIG. 1, are used in an effort to align the fibers relative to each other before contact with a polishing apparatus. As shown in FIG. 1, the fibers 110 are threaded through aligning stems or receptacles 120 so as to protrude below the base 130. Note that the illustrated length of the fiber ends 110*a* protruding below the base 130 has been exaggerated for clarity. Also, each of the fiber ends are typically surrounded by a ceramic material, such as zirconia, to provide support and protection for the fiber ends. The details of the ceramic material have been omitted for clarity. As shown in the schematic side view in FIG. 2, if the individual fibers 110 are not evenly aligned relative to each other, the ends of the fibers 110*a* will experience different polishing rates, which can cause some of the alignment losses discussed above, such as lack of perpendicularity, rough edges, or excessive separation. Again, the dimensions in FIG. 2 have been exaggerated to illustrate the non-alignment problem. In practice, the alignment precision would be at a submicron level, which makes conventional direct visual inspection ineffective.

Any defects caused by misalignment during the polishing process are therefore not discovered until the subsequent testing phase. The defective optical fibers must then be reworked and retested, which results in a loss of throughput and decreased efficiency.

Accordingly, there exists a need for a leveling apparatus and method of precisely leveling or balancing the optical fibers relative to each other, prior to the polishing step, to ensure polishing uniformity and to reduce the number of defective optical fibers.

SUMMARY OF THE INVENTION

The present invention is therefore directed to an leveling apparatus and method that substantially overcomes one or more of the problems due to the limitations and disadvantages of the conventional art.

As used in the specification, the terms "align" or "aligned" refer to the situation where all the optical fibers protrude below the aligning device at equal lengths. The terms "leveling" or "balancing", and alternative forms thereof, refer to the situation where the distal ends of all the aligned fibers are level relative to a horizontal reference plane. In other words, even though all the fiber distal ends extend below the aligning device at the same length, they may not be horizontally leveled or balanced with respect to an external reference, such as the horizontal plane defined by the upper surface of the polishing pad, since the aligning device itself may be titled with respect to the external reference. Therefore, the aligning device should contact the polishing pad in a substantially parallel and horizontal manner, that is, without titling, so that each of the distal ends of each of the aligned and leveled optical fibers experiences the same polishing rate when contacting a polishing pad during a polishing operation.

In general, the present invention utilizes a sensor array which contacts the optical fibers protruding from the aligning device. The sensor array uses a plurality of sensors, such as piezoelectric sensors or infrared sensors, to identify the actual horizontal alignment profile of the optical fibers in the aligning device. Then, the actual horizontal alignment profile is translated into a readily perceived visual indication of the horizontal alignment profile on a monitor, after which adjustments can be made to ensure precise leveling or balancing of the fibers prior to the polishing step.

To achieve these and other advantages, the present invention comprises an optical fiber leveling apparatus for leveling respective distal ends of a plurality of optical fibers. The apparatus includes an aligning device having a plurality of receptacles for securing the corresponding plurality of optical fibers, such that the distal end of each optical fiber extends below the base of the aligning device. A sensor array contacts the distal ends of the optical fibers and generates sensor alignment signals indicating the position of the distal ends extending below the aligning device relative to a horizontal reference plane. A monitor receives and displays digital signals corresponding to the sensed alignments signals in a format readily perceived by an operator. Those optical fibers that are not aligned and leveled are then adjusted until all the fibers are aligned and leveled relative to the horizontal reference plane as viewed on the monitor.

The sensor array may be composed of a number of individual piezoelectric sensors, infrared sensors, or other sensors capable of discerning the horizontal alignment profile of the optical fibers.

In another aspect, the invention provides a method of leveling a plurality of optical fibers. First, the plurality of optical fibers are secured in an aligning device such that a distal end of each optical fiber extends beyond a base of the aligning device. Next, the distal ends of the optical fibers are brought into contact with a sensor array. The sensor array generates alignment signals indicative of a position of the distal ends extending beyond the base of the aligning device relative to a horizontal reference plane. The alignment signals are sent to a monitor to provide a readily perceived visual indication of the horizontal alignment profile of the fiber ends. The distal ends of those fibers that are not aligned and leveled are then adjusted accordingly.

BRIEF DESCRIPTION OF THE DRAWINGS

The foregoing and other objects, aspects and advantages will be described with reference to the drawings, in which.

DETAILED DESCRIPTION OF THE PREFERRED EMBODIMENTS

While the present invention is described herein with reference to illustrative embodiments for particular applications, it should be understood that the present invention is not limited thereto. Those having ordinary skill in the art and access to the teachings provided herein will recognize additional modifications, applications, and embodiments within the scope thereof and additional fields in which the invention would be of significant utility without undue experimentation.

Figure 1:
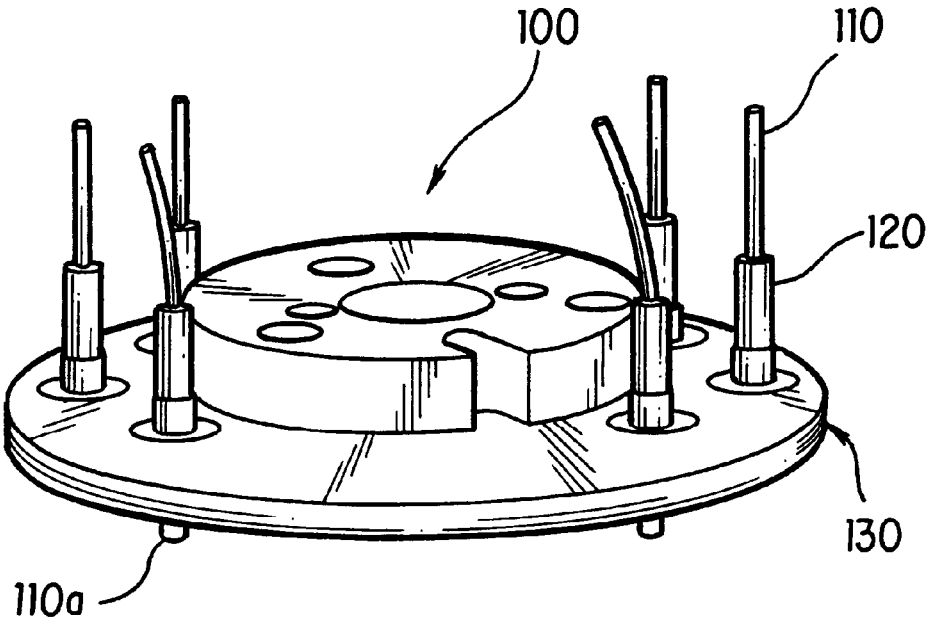
FIG. 1 is a perspective view of an aligning device.
Figure 2:
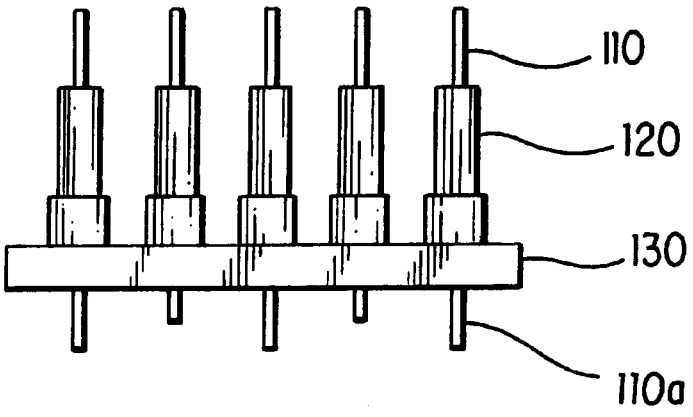
FIG. 2 is a schematic side view showing improperly aligned fibers.
Figure 3:
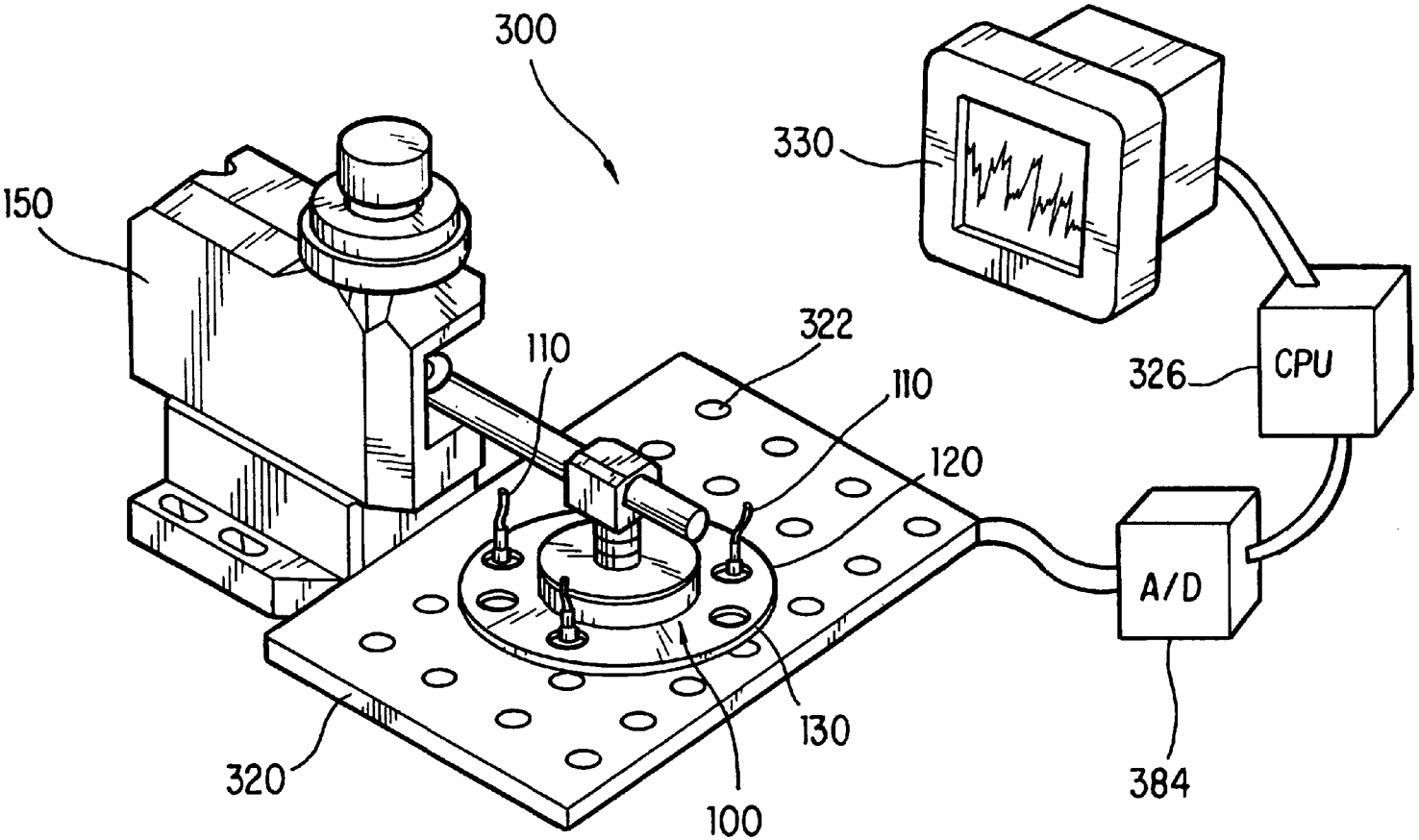
FIG. 3 is a schematic view of a leveling apparatus of the present invention.

FIG. 3 illustrates a leveling apparatus 300 in accordance with the present invention. The major components of the leveling apparatus 300 include an aligning device 100, a sensor array 320, and a visual display device 330. The aligning device 100 may be any conventional device, such as that shown in FIG. 1. Any number of fibers 110 may be accommodated by providing the requisite number of alignment stems or receptacles 120 in the aligning device to secure the fibers 110. The distal ends 110*a* are threaded through the aligning device 100, such that they protrude below the base 130 of the aligning device 100 (see FIG. 2).

Note that even if all the fiber distal ends extended below the aligning device at the same length, they still may not be horizontally level or balanced with respect to an external reference, such as the horizontal plane defined by the upper surface of the sensor array 320, since the aligning device 100 itself may be titled with respect to the external reference. Therefore, if the aligning device contacts the polishing pad in a substantially parallel and horizontal manner, the fiber ends are both aligned and leveled and the horizontal alignment profile of the fiber ends would be equal. The distal ends of each of the aligned and leveled optical fibers thus experiences the same polishing rate when contacting a polishing pad during a polishing operation.

The required fiber distal end horizontal alignment precision is at the submicron level. Accordingly, un-aided visual inspection of the horizontal alignment profile is ineffective to ensure precise fiber distal end alignment before commencing the polishing process. Accordingly, to achieve greater accuracy in alignment detection and in alignment adjustments, the protruding fiber distal ends are made to contact the sensor array 320, using any conventional apparatus 150 that allows for precise and controlled movement of the aligning device 100.

The sensor array 320 may comprise any number of individual sensors 322. The sensors 322 are preferably laid out in a grid pattern, for example, a 1,000×1,000 sensor matrix, although more or fewer sensors 322 may be employed as necessary to either increase or decrease the measurement precision. Preferably, the sensors 322 are pressure sensors composed of piezoelectric devices, which are non-conducting crystals that produce electricity when subjected to pressure (compression) or strain forces. Different pressures exerted by each of the fiber distal ends 110*a* would thus generate different voltage or current levels in the piezoelectric devices.

In operation, when the fiber distal ends 110*a* from the aligning device 100 contact the sensor array 320, the various fiber distal ends 110*a* exert a certain pressure on the array 320, based on the their horizontal alignment profile relative to the other fiber distal ends. The fiber distal ends 110*a* that protrude the most from the other fibers will exert the most pressure on the sensor array 320. The other less-protruding fiber distal ends 110*a* would exert proportionately less pressure on the sensor array 320. Also, if the aligning device 100 is tilted, greater pressure will be experienced by those fiber distal ends 110*a* where the aligning device 100 tilts toward the sensor array 320, and less pressure will be experienced by those fiber distal ends 110*a* where the aligning device 100 tilts away from the sensor array 320. The pressure exerted by each fiber distal end 110*a* is then converted to a voltage level, which is ultimately mapped to the monitor 330 to provide a readily perceived visual representation of the pressure differences associated with the horizontal alignment profile of the optical fibers. By monitoring the pressure, one can determine the horizontal alignment profile of the fiber distal ends, that is, the relative alignment of the fiber distal ends with respect to a horizontal reference plane.

Other types of sensors, such as infrared (IR) sensors, may be used in the sensor array 320. The IR sensors would detect differences in the distances between the fiber distal ends 110*a* and the sensor array 320 surface based on the magnitude of the thermal signature of the particular fiber distal end. The different thermal signatures would then be displayed by the monitor 330. One of ordinary skill in the art would recognize that other equivalent sensors may be used, so long as the sensors were able to identify differences in the horizontal alignment profile of the fiber distal ends.

Regardless of the type of sensor employed, an analog to digital (A/D) converter 324, integrally formed in the sensor array 320, or separately provided, converts the analog horizontal alignment profile information from the sensor array 320 into a digital alignment signal for further processing by a conventional image processor 326 for subsequent display by the monitor 330.

At the monitor 330, the horizontal alignment profile can be displayed in any number of ways. For example, when using the piezoelectric sensor devices, different pressures (and thus different horizontal alignment profiles) can be represented by different colors, by different heights on a vertical bar graph, by different lengths on a horizontal line graph, etc. In a similar fashion the horizontal alignment profile can be represented in any number of ways if other sensing devices are used. Any displayed representation that provides a visual indication of the relative height differential of the fiber distal ends with respect to the horizontal reference plane may be used.

Once the relative alignment of the fibers or horizontal alignment profile is ascertained by the apparatus of the present invention, an operator can easily determine which of the fibers distal ends 110*a* needs to be adjusted merely by viewing the visual representation on the monitor 330. The specific optical fibers that are not aligned can then be adjusted or leveled, by using adjusting screws on the adjusting stems, for example. The resulting horizontal alignment profile can then be viewed again on the monitor 330 and further adjustments can be made if necessary.

The precision of the alignment offered by the sensor array and digital monitor display allows the subsequent polishing process to be performed with a greater degree of reliability and consistency.

Figure 4:
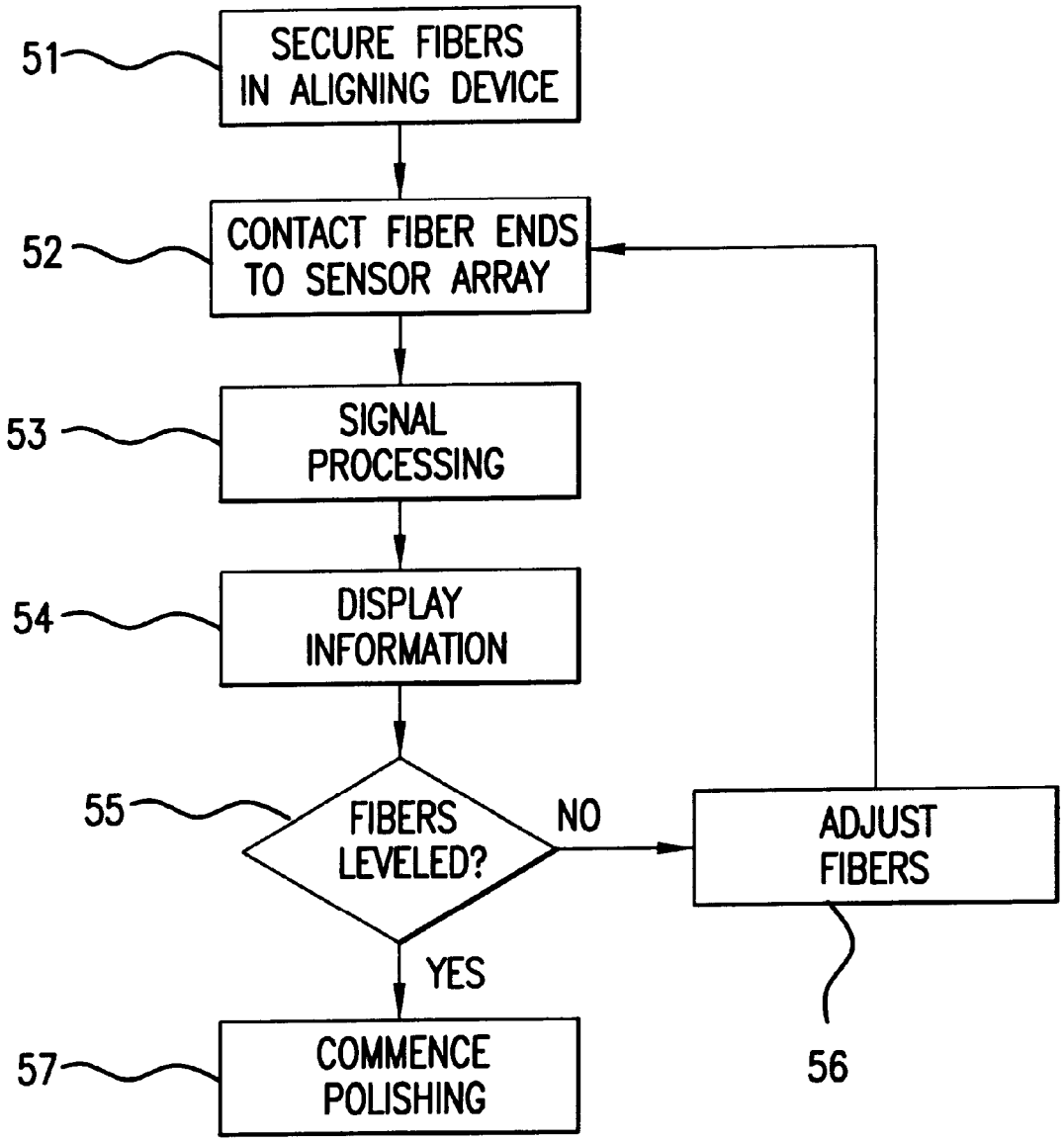
FIG. 4 is a block diagram of a leveling method of the present invention employing the apparatus of FIG. 3.

FIG. 4 illustrates the general method of the present invention. In step S1, the optical fibers are threaded through the aligning device, and thereafter brought into contact with the sensor array in step S2. The sensor array converts a pressure force exerted by the optical fiber on a piezoelectric transducer, or a thermal signature of an IR sensor, or other analog sensor alignment information, into an analog voltage level. An analog to digital (A/D) converter may be employed either in the sensor array, or separately, to convert the analog sensor alignment signals into digital signals for processing by a conventional image processor in step S3. This digital alignment information is then displayed on the monitor in step S4 to show the horizontal alignment profile of the optical fibers. In step S5 it is determined whether the fibers are horizontally aligned and leveled. If not, an adjusting step S6 is repeatedly performed until the monitor representation of the horizontal alignment profile indicates that all optical fibers are horizontally aligned and leveled. If and when the fibers are aligned and leveled, the polishing process is then performed on the optical fibers in step S7.

Although preferred embodiments of the present invention have been described in detail herein above, it should be clearly understood that many variations and/or modifications of the basic inventive concepts herein taught, which may appear to those skilled in the art, will still fall within the spirit and scope of the present invention as defined in the appended claims and their equivalents.

What we claim as new and desire to secure by Letters Patent is as follows:

1. An optical fiber alignment apparatus for leveling respective distal ends of a plurality of optical fibers, comprising:

an aligning device having a plurality of receptacles for securing the plurality of optical fibers therein, wherein a distal end of each optical fiber extends below a base of the aligning device;

a sensor array for contacting the distal ends of the optical fibers and for generating sensor alignment signals indicative of a position of the distal ends extending below the aligning device relative to a horizontal reference plane; and a monitor for receiving and displaying digital alignment signals representative of the sensor alignments signals, a position of non-aligned fibers in the receptacles of the aligning device being further adjustable based on an output from said monitor so that the fiber distal ends are leveled relative to the horizontal plane.

2. The apparatus of claim 1, wherein the sensor array is composed of a plurality of sensors arranged in a matrix grid.

3. The apparatus of claim 2, wherein the plurality of sensors are infrared sensors.

4. The apparatus of claim 2, wherein the plurality of sensors are piezoelectric sensors.

5. The apparatus of claim 2, wherein the sensor alignment signals are analog signals, and further comprising an analog to digital converter for receiving and converting the analog sensor alignment signals to the digital alignment signals.

6. The apparatus of claim 5, further comprising an image processing apparatus for receiving the digital alignment signals and for processing the digital alignment signals for display on the monitor.

7. A method of leveling a plurality of optical fibers, comprising steps of:

securing a plurality of optical fibers in an aligning device such that a distal end of each optical fiber extends below a base of the aligning device;

contacting the distal ends of the optical fibers to a sensor array;

generating sensor alignment signals from the sensor array indicative of a position of the distal ends extending below the aligning device relative to a horizontal reference plane;

receiving and displaying, on a monitor, a plurality of digital alignment signals representative of the sensor alignment signals; and further adjusting a position of the respective fibers secured in the aligning device for leveling the fiber distal ends relative to the horizontal reference plane in accordance with said displayed plurality of digital alignment signals.

8. The method of claim 7, wherein said sensor alignment signals are analog signals and further comprising a step of converting the analog sensor alignment signals to the plurality of digital alignment signals.

9. The method of claim 8, further comprising steps of receiving the plurality of digital alignment signals and processing the plurality of digital alignment signals for display on the monitor.

10. The method of claim 9, wherein said adjusting step is repeatedly performed until all the fiber distal ends are level as displayed on the monitor.

* * * * *